US011365594B2

(12) United States Patent
Dow et al.

(10) Patent No.: US 11,365,594 B2
(45) Date of Patent: Jun. 21, 2022

(54) NON-STOP CIRCULATION SYSTEM FOR MAINTAINING BOTTOM HOLE PRESSURE

(71) Applicant: Schlumberger Technology Corporation, Sugar Land, TX (US)

(72) Inventors: Blaine Dow, Sugar Land, TX (US); Zaurayze Tarique, Calgary (CA); Scott Coffey, Houston, TX (US); Justin Cremer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/478,842

(22) PCT Filed: Jan. 18, 2018

(86) PCT No.: PCT/US2018/014127
§ 371 (c)(1),
(2) Date: Jul. 17, 2019

(87) PCT Pub. No.: WO2018/136573
PCT Pub. Date: Jul. 26, 2018

(65) Prior Publication Data

US 2020/0056432 A1 Feb. 20, 2020

Related U.S. Application Data

(60) Provisional application No. 62/447,718, filed on Jan. 18, 2017.

(51) Int. Cl.
*E21B 21/08* (2006.01)
*E21B 17/18* (2006.01)
(Continued)

(52) U.S. Cl.
CPC ..... *E21B 21/08* (2013.01); *E21B 17/18* (2013.01); *E21B 17/1085* (2013.01);
(Continued)

(58) Field of Classification Search
CPC ..... E21B 17/18; E21B 19/08; E21B 19/16; E21B 21/08; E21B 21/10; E21B 21/106; E21B 21/12
See application file for complete search history.

(56) References Cited

U.S. PATENT DOCUMENTS 6,412,554 B1 * 7/2002 Allen ..... E21B 3/04 166/80.1
2011/0303462 A1 * 12/2011 Lovorn ..... E21B 21/106 175/48
2014/0224509 A1 * 8/2014 Yajure ..... E21B 21/106 166/380

FOREIGN PATENT DOCUMENTS

EP 2910728 A2 8/2015
WO 2004/074627 A1 9/2004
(Continued)

OTHER PUBLICATIONS

International Search Report and Written Opinion for the equivalent International patent application PCT/US2018/014127 dated Jun. 14, 2018.

(Continued)

*Primary Examiner* — Tara Schimpf
(74) *Attorney, Agent, or Firm* — Kelly McKinney

(57) ABSTRACT

A method for maintaining a constant bottom hole pressure during wellbore drilling operations, the method comprising supplying drilling fluid to the drill string via a top drive at a first pressure while flow of drilling fluid out of a wellbore annulus is restricted by a choke to hold pressure in a wellbore annulus and supplying drilling fluid to the drill string via the top drive at a second pressure lower than the first pressure and to a circulation coupler at a third pressure while flow of drilling fluid out of a wellbore annulus is restricted by a choke to hold pressure in the annulus, wherein the sum of the second and third pressures is
(Continued)

approximately the same as the first pressure. The method also comprises supplying drilling fluid to the drill string via the circulation coupler at the third pressure while pumping drilling fluid into the wellbore annulus by a back pressure pump, wherein the bottom hole pressure at the bottom of the wellbore is maintained substantially constant during all steps of supplying drilling fluid to the drill string.

16 Claims, 5 Drawing Sheets

(51) Int. Cl.

| | |
|---|---|
| *E21B 17/10* | (2006.01) |
| *E21B 19/16* | (2006.01) |
| *E21B 21/10* | (2006.01) |
| *E21B 33/035* | (2006.01) |

(52) U.S. Cl.
CPC ..... *E21B 19/165* (2013.01); *E21B 21/106* (2013.01); *E21B 33/0355* (2013.01)

(56) References Cited

FOREIGN PATENT DOCUMENTS

| | | | |
|---|---|---|---|
| WO | 2012/22468 | A2 | 9/2012 |
| WO | 2012122468 | A1 | 9/2012 |

OTHER PUBLICATIONS

International Preliminary Report on Patentability for the equivalent International patent application PCT/US2018/014127 dated Aug. 1, 2019.

* cited by examiner

NON-STOP CIRCULATION SYSTEM FOR MAINTAINING BOTTOM HOLE PRESSURE

This application claims the benefit of and priority to a US Provisional Application Ser. No. 62/447,718, filed 18 Jan. 2017, which is incorporated by reference herein.

BACKGROUND

During downhole drilling operations, an earth-boring drill bit is typically mounted on the lower end of a drill string and is rotated by rotating the drill string at the surface or by actuation of downhole motors or turbines, or by both methods. When weight is applied to the drill string, the rotating drill bit engages the earthen formation and proceeds to form a borehole along a predetermined path toward a target zone. Because of the energy and friction involved in drilling a wellbore in the earth's formation, drilling fluids, commonly referred to as drilling mud, are used to lubricate and cool the drill bit as it cuts the rock formations below. Furthermore, in addition to cooling and lubricating the drill bit, drilling mud also performs the secondary and tertiary functions of removing the drill cuttings from the bottom of the wellbore and applying a hydrostatic column of pressure to the drilled wellbore.

Typically, drilling mud is delivered to the drill bit from the surface under high pressure through a central bore of the drill string. From there, nozzles on the drill bit direct the pressurized mud to the cutters on the drill bit where the pressurized mud cleans and cools the bit. As the fluid is delivered downhole through the central bore of the drill string, the fluid returns to the surface in an annulus formed between the outside of the drill string and the inner profile or wall of the drilled wellbore. Drilling mud returning to the surface through the annulus does so at lower pressures and velocities than it is delivered. Nonetheless, a hydrostatic column of drilling mud typically extends from the bottom of the hole up to a bell nipple of a diverter assembly on the drilling rig. Annular fluids exit the bell nipple where solids are removed, the mud is processed, and then prepared to be re-delivered to the subterranean wellbore through the drill string.

As wellbores are drilled several thousand feet below the surface, the hydrostatic column of drilling mud in the annulus serves to help prevent blowout of the wellbore, as well. Often, hydrocarbons and other fluids trapped in subterranean formations exist under significant pressures. Absent any flow control schemes, fluids from such ruptured formations may blow out of the wellbore and spew hydrocarbons and other undesirable fluids (e.g., H2S gas). Problems encountered during perforation include: (i) kick phenomena in the formation, which bring a reservoir of high-pressure gases or fluids up to the surface; (ii) absorption phenomena in the well during perforation, which yield to loss of drilling mud in the formation resulting in environmental and economic damage; (iii) control of the properties of the mud entering the well; (iv) control of the properties of the mud exiting the well; (v) ascent of gases which can lead to hazards; (vi) ability to load the drill pipes in safety; and (vii) control of all physical and fluid dynamical properties involved in the drilling.

An overbalanced technique is commonly used, wherein the pressure generated by the fluid in the annulus exceeds the formation pore pressure so as to control the release of formation fluid into the borehole. Additives may be added to increase fluid density in the fluid column, but it may take too long to get the additives into the annulus to be able to control a fluid release, and if the fluid column is made too heavy the formation fracture pressure may be exceeded so that the borehole permeability may be adversely affected.

For mud circulation drilling, several systems have been developed to allow control of the flow entering and exiting the well and to avoid kick and absorption phenomena. The flow of drilling mud entering the well may be determined by the pumping equipment, therefore the flow may be held constant. In standard conditions and barring any anomalies, the flow exiting the well must be equal to the flow entering the well for less than a measurement error. In many cases the exiting flow is not constant and is often not even comparable to the entering flow, despite accounting for measurement errors. This variation is due to phenomena occurring inside the well, which can sometimes compromise the outcome of the drilling operation. Several well-control systems employed in mud circulation drilling control entry and exit flows and pressures via choke valves and sensors to control and monitor the well's backpressure to predict and manage any possible hazards.

However, the standard systems do not provide control over the flows when the pumps are shut down during drill pipe loading/tripping. In this stage of drilling, there is a danger of kick phenomena because pressure is not maintained constant inside the hole, and the subsequent cycle of increases and decreases in pressure on the well walls induces hydraulic fracturing in undesired places. Furthermore, continuous circulation helps to prevent debris from falling towards the bottom of the well, but instead it keeps it moving upwards so as to prevent the drill string from getting stuck.

There is a need for a drilling control system that maintains bottom hole pressure during all phases of drilling.

SUMMARY

In accordance with the teachings of the present disclosure, disadvantages and problems associated with existing drilling and flow control systems and methods have been reduced.

An aspect of the invention provides a method for maintaining a constant bottom hole pressure during wellbore drilling operations, the method comprising: supplying drilling mud to the drill string via a top drive at a first pressure while flow of drilling mud out of a wellbore annulus is restricted by a choke to hold pressure in a wellbore annulus; supplying drilling mud to the drill string via the top drive at a second pressure lower than the first pressure and to a circulation coupler at a third pressure while flow of drilling mud out of a wellbore annulus is restricted by a choke to hold pressure in the annulus, wherein the sum of the second and third pressures is approximately the same as the first pressure; and supplying drilling mud to the drill string via the circulation coupler at the third pressure while pumping drilling mud into the wellbore annulus by a back pressure pump, wherein the bottom hole pressure at the bottom of the wellbore is maintained substantially constant during all steps of supplying drilling mud to the drill string.

BRIEF DESCRIPTION OF THE DRAWINGS

A more complete understanding of the present embodiments may be acquired by referring to the following description taken in conjunction with the accompanying drawings, in which like reference numbers indicate like features.

DETAILED DESCRIPTION

Preferred embodiments are best understood by reference to FIGS. 1-4 below in view of the following general discussion. The present disclosure may be more easily understood in the context of a high level description of certain embodiments.

Figure 1:
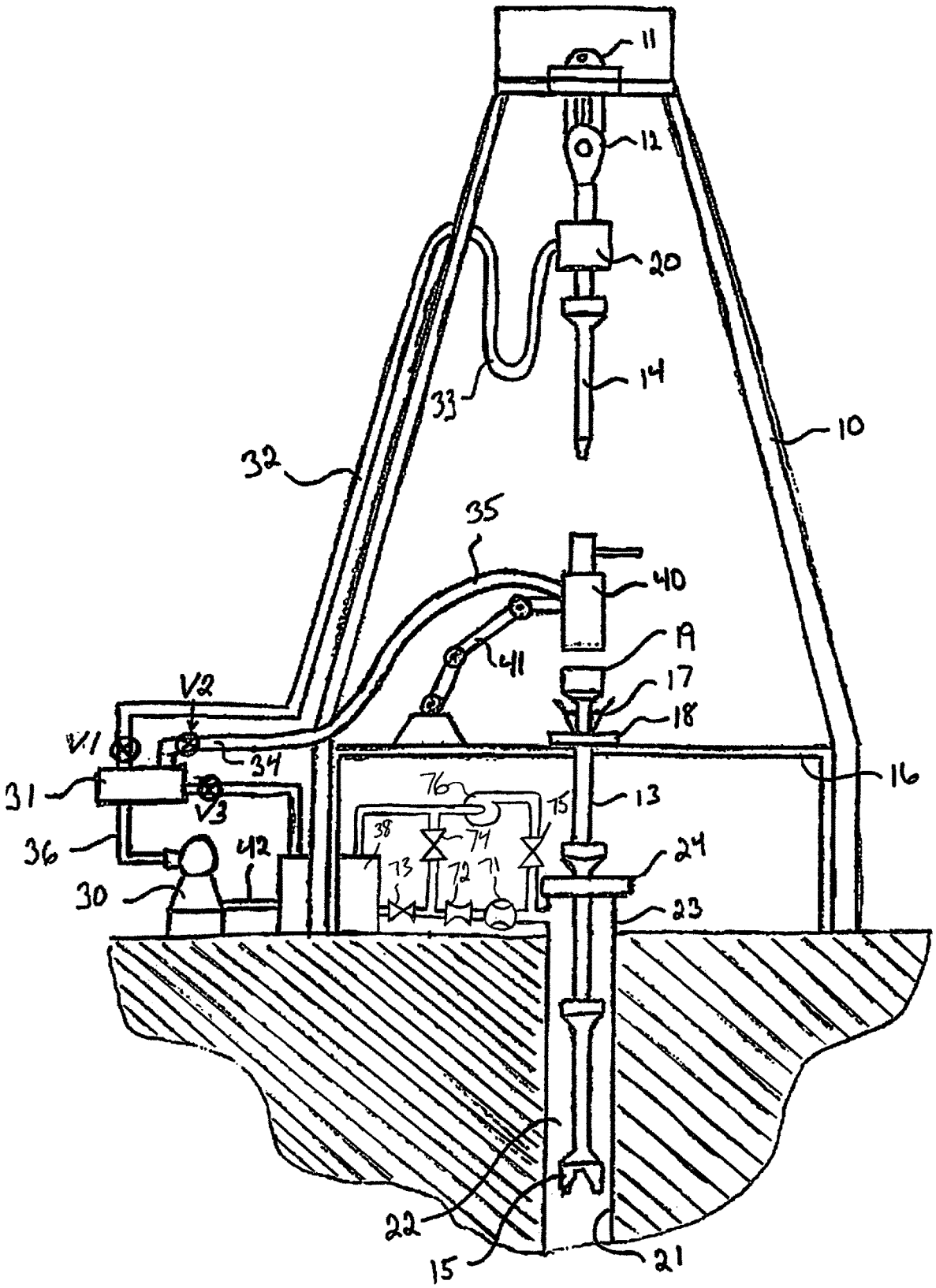
FIG. 1 illustrates a drilling system for tripping drill string with constant circulation bottom hole pressure.

FIG. 1 shows an embodiment of the invention. A drilling derrick 10 supports a crown block 11 and a travelling block 12 for making up drill pipe 14 sections of a drill string 13. A top drive 20 is suspended from the travelling block 12. A drill bit 15 is made up to the end of the drill string 13. The drill string 13 is suspended from the rig floor 16 via slips 17 in a rotary table 18 so that a stump 19 extends above the rig floor 16. The drill string 13 extends into the wellbore 21 so that there is an annulus 22 between the exterior of the drill sting 13 and the walls of the wellbore 21. A surface casing 23 extends from the top of the wellbore 21 and a rotating control device 24 is attached to the top of the surface casing 23. A blow out preventer (BOP), not shown, may be incorporated into the surface casing.

Drilling mud is circulated via a mud pump 30. The drilling mud is supplied to the drill string 13 via a diverter manifold 31. A pressure line 36 extends from the mud pump 30 to the diverter manifold 31. A line extends from the diverter manifold to the stand pipe 32, wherein the stand pipe 32 is connected to the top drive 20 via a rotary hose 33. Another line extends from the diverter manifold 31 floor pipe 34, wherein the floor pipe 34 is connected to a circulation coupler 40 via a rotary hose 35. The circulation coupler 40 is supported above the rig floor 16 via an arm 41. A discharge line 37 extends from the diverter manifold 31 to a retention tank or sump 38. Drilling mud being circulated up the annulus 22 is returned to the retention tank 38 via return line 39 connected to the surface casing 23 below the rotating control device 24. Drilling mud from the retention tank 38 is supplied to the mud pump 30 via a supply line 42.

During drilling, the mud pump 30 injects drilling mud through the top drive 20 into the drill string 13. The diverter manifold is configured to only supply drilling mud to the stand pipe 32. When a stand of drill pipe 14 is to be added to the drill string 13, the drill string 13 is raised and the slips 17 are set. The circulation coupler 40 is coupled to the stump 19 of the drill string 13 so as to engage a circulation sub having a radial port. The operator may then increase a supply of drilling mud to the circulation coupler 40 while a supply of drilling mud to the top drive 20 is decreased, so as to maintain a constant circulation while the supply is shifted from the top drive 20 to the circulation coupler 40. When drilling mud is no longer being supplied to the top drive 20, the top drive 20 is disconnected from the stump 19 of the drilling string 13 and another stand of drill pipe 14 is made up to the top drive 20. While the top drive 20 is disconnected from the drill string 13, the rotary table 18 may continue to turn the drill string 13 while drilling mud is supplied to the drill string 13 via the circulation coupler 40. The new stand of drill pipe 14 may then be made up to the stump 19 of the drill string 13. The operator may then decrease a supply of drilling mud to the circulation coupler 40 while a supply of drilling mud to the top drive 20 is increased, so as to maintain a constant circulation while the supply is shifted from the circulation coupler 40 to the top drive 20. Both the top drive 20 and the rotary table 18 may rotate the drill string 13 as circulation is shifted from the circulation coupler 40 to the top drive 20.

Figure 2:
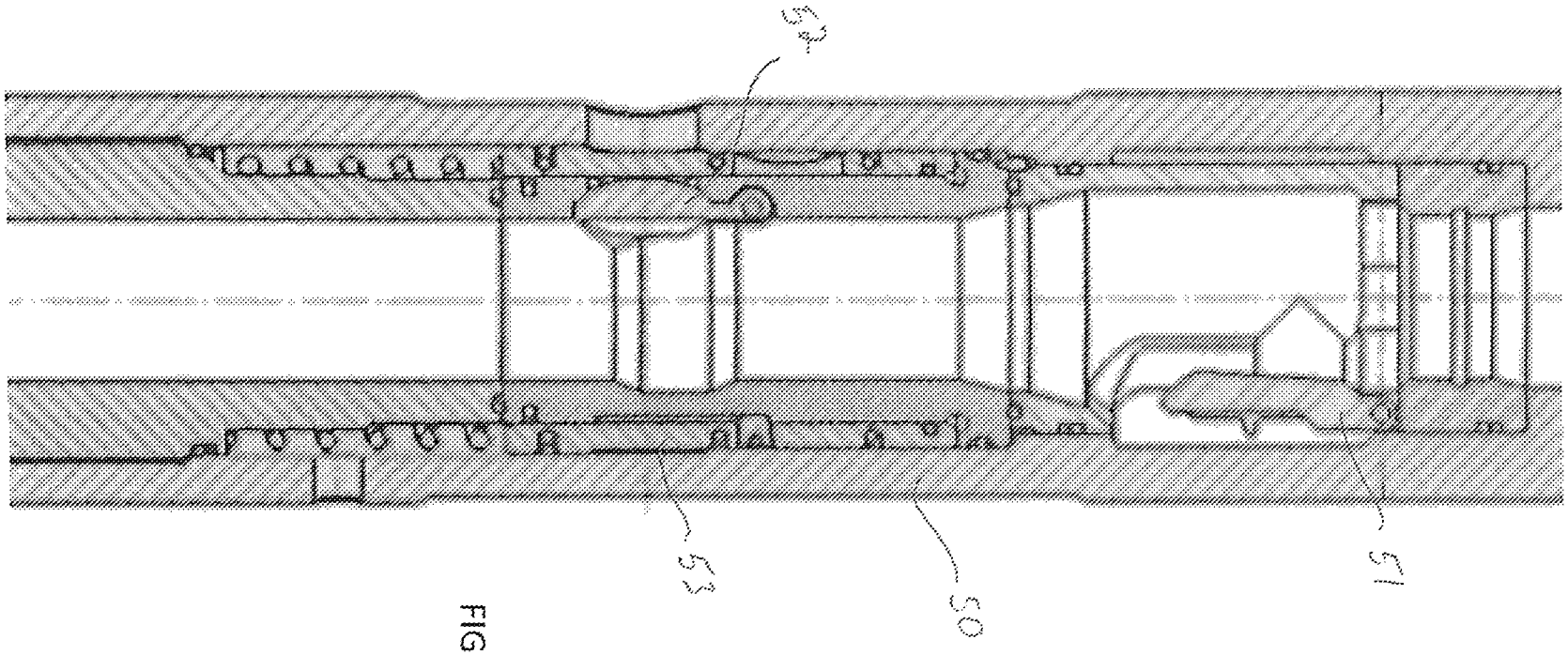
FIG. 2 shows a cross-sectional side view of a constant circulation sub.
Figure 5:
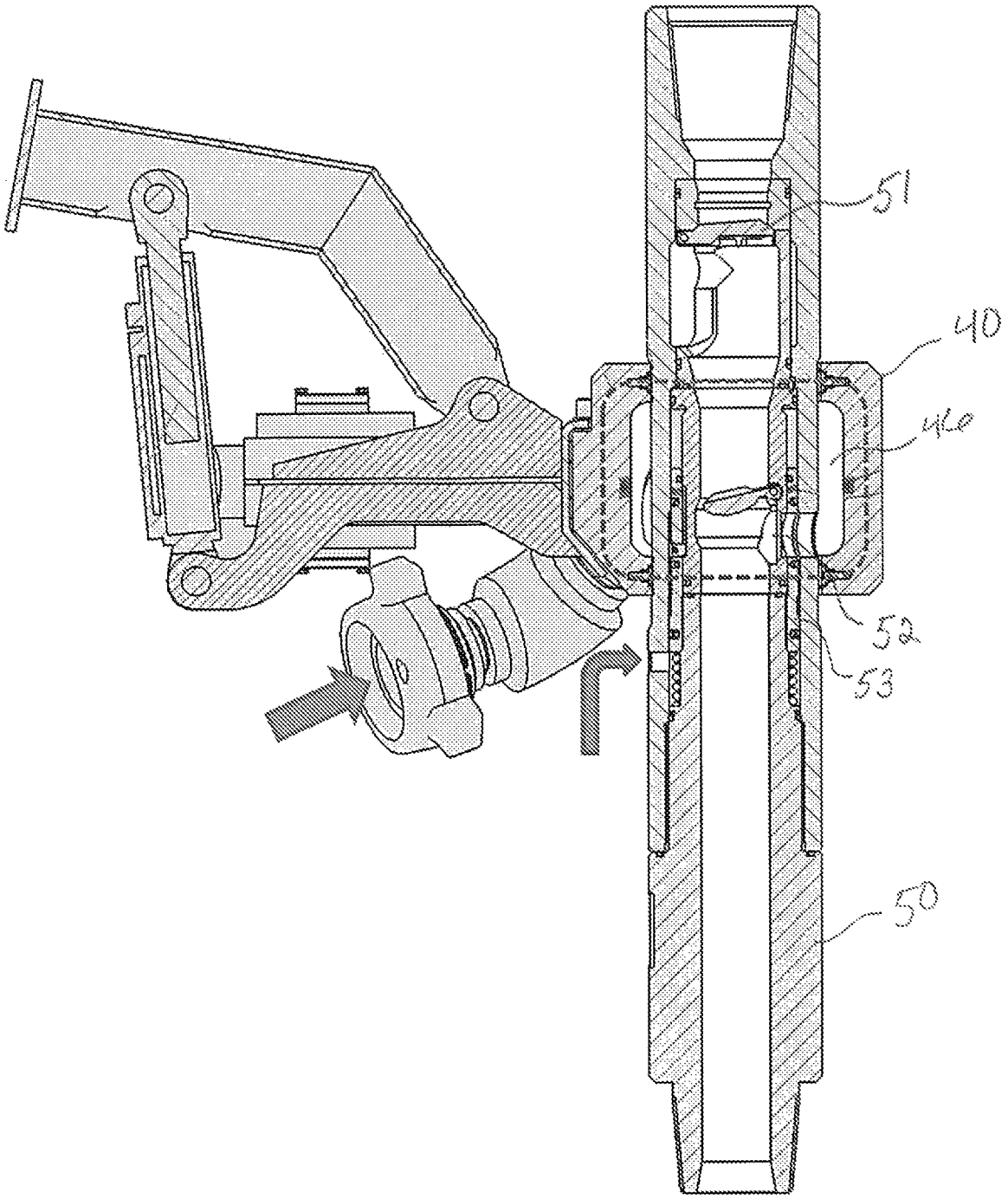
FIG. 5 illustrates a cross-sectional side view of a constant circulation sub engaged by a circulation coupler to form a chamber around a radial valve of the constant circulation sub.

FIG. 2 provides a cross-sectional side view of a constant circulation sub 50. The sub has an axial valve 51 and a radial valve 52. The valves are meant to be incorporated in the drilling string. Their external measures are similar to drilling pipes and they do not preclude the passage of special equipment inside them (i.e. OD 7"-ID $2^{13}/_{16}$"). They are formed by two valves, an axial 51 and a radial 52, both retractable, which allow the passage of fluids in both directions and allow rod replacement to happen without interruptions of the mud flow. The axial valve set 51 is composed of a jacket housing a swing pattern valve closing in the axial direction of the drilling mud. The axial swing check valve 51, capable of rotating on an orthogonal pivot, stays open by gravity when oriented vertically thanks to its weight, and thanks to centrifugal and hydrodynamic forces during perforation (even during horizontal perforation). The liner houses the valve 51 in such a way that it does not interfere with the passage of equipment inside the drilling string 13. The valve 51 is automatically closed when the flow is reversed, because it is rotated by hydrodynamic forces. In this situation the valve 51 is lifted from the jacket and seals perfectly the seat. Inside the body there is a second jacket with an internal swing check valve 52 and an external sliding valve 53. The operation of the sliding valve 53 is similar to that of a hydraulic piston. The sliding occurs thanks to difference in pressure between two chambers. In particular, the sliding compresses a spring which, once the pressure is balanced again, shuts the valve 53. This pressure difference between the two regions of the valve only happens when the circulation coupler 40 surrounds the constant circulation sub 50 and supplies relatively high pressure drilling mud to the outside of the sliding valve 53 (see FIG. 5). In all other cases, the areas subjected to external pressure favor the closing of the valve 53, given that the area pushed by the spring is much bigger than the area subject to lateral pressure.

Referring again to FIG. 1, during drilling the drill string 13 is suspended within the circulation coupler 40. The mud pump 30 injects drilling mud through the top drive 20 connected to the stump 19 of the drill string 13. In this case, valve V1 may be open and valves V2 and V3 may be closed. When a stand of drill pipe 14 needs to be added to the drill string 13, the drill string 13 is raised and the slips 17 set. The drill string may continue to be rotated via the rotary table 18 or the top drive 20. The circulation coupler 40 is positioned on the drill string so that it is around the constant circulation sub 50 made up to the topmost stand of drill pipe 14 in the drill string 13. The controller may then begin to close valve V1 and apply pressure to the chamber 46 inside the circulation coupler 40 by opening valve V2. The increased pressure of the drilling mud inside the chamber 46 opens the sliding valve 53 in the constant circulation sub 50 (see FIG. 5) so that drilling mud begins to flow into the drill string through sliding valve 53 and radial valve 52. As valve V1 is fully closed and valve V2 is fully open, the axial valve 51 of the constant circulation sub 50 closes so that the top drive 20 may be disconnected from the stump 19 of the drill string (see FIG. 5). The drill string may continue to be rotated via the rotary table 18.

A new stand of drill pipe 14 may then be made up to the top drive 20. While the drill string is being rotated via the rotary table 18 and drilling mud is being circulated via the circulation coupler 40, the new stand of drill pipe 14 may be made up to the stump 19 of the drill string 13 via the top drive 20. Once the new stand of drill pipe 14 is connected to and become part of the drill string 13, the drill string 13 may continue to be rotated via the rotary table 18 or the top drive 20. The drill string 13 may be lifted by the top drive 20 and the slips 17 released. Drilling mud may continue to be circulated through the drill string 13 by opening valve V1 to supply drilling mud to the top drive 20, while V2 is partially closed to reduce fluid flow to the circulation coupler 40. As drilling mud begins to flow down through the internal bore of the constant circulation sub 50, the axial valve 51 will open and the radial valve 52 will close. Valve V3 is opened to allow the drilling mud in the circulation coupler 40, rotary hose 35 and floor pipe 34 to drain back into the retention tank 38. As the pressure is relieved from the chamber 46 in the circulation coupler 40, the drill string 13 may continue to be rotated and lowered to continue drilling the well bore 21. The drill string 13 slides down through the circulation coupler 40 during drilling operations until a new stand of drill pipe 14 is to be added to the drill string 13 and the process is repeated.

When drill string 13 is tripped out of the well bore 21, a similar process is followed, in reverse order, to allow constant circulation of drilling mud and constant rotation of the drill string 13.

In the embodiment of the invention shown in FIG. 1, the circulation coupler 40 is supported by an arm 41. However, in alternative embodiments, the circulation coupler may be mounted on a blow-out preventer (BOP) stack in a modular fashion. Alternatively, the circulation coupler 40 may be integral with a blow-out preventer (BOP) stack. In still further embodiments, the circulation coupler 40 may be mounted in a marine riser above a diverter or rotating control device. In still further embodiments, the circulation coupler 40 may be mounted anywhere in a drilling system so as to enable constant rotation of the drill string and constant circulation of drilling mud through the drill string.

FIG. 1 also illustrates a back pressure system for maintaining bottom hole pressure. The back pressure system comprises a set of valves, meters and a pump that enable controlled restriction of flow from the annulus 22 and reverse circulation of flow back into the annulus 22. For controlled restriction of flow from the annulus 22, the drilling mud flows to a flow meter 71, a choke 72, a valve 73 and into the retention tank 38, wherein valves 74 and 75 are closed. The flow meter 71 may be a mass-balance or high-resolution flow meter that monitors how much drilling mud has returned from the wellbore 21. A similar flow meter (not shown) may be implemented in the diverter manifold 31 to monitor how much drilling mud has been pumped into the wellbore, so that a comparison of fluids into and out of the wellbore may be obtained. A loss of fluid to the wellbore may indicate detrimental formation fracturing. A gain of fluid from the wellbore may indicate formation fluids have entered the wellbore and mixed with the drilling mud. A choke 72 restricts the flow of drilling mud from the annulus 22 to apply back pressure. The choke 72 may be a variable choke capable of variable flow and pressure settings. It may be a wear resistant choke capable of multiple cycles with drilling mud flowing through it. For controlled reverse circulation of drilling mud back into the annulus 22 from the retention tank 38, valves 73 and 74 are closed, valve 75 is open, and back pressure pump 76 is turned on.

Figure 3:
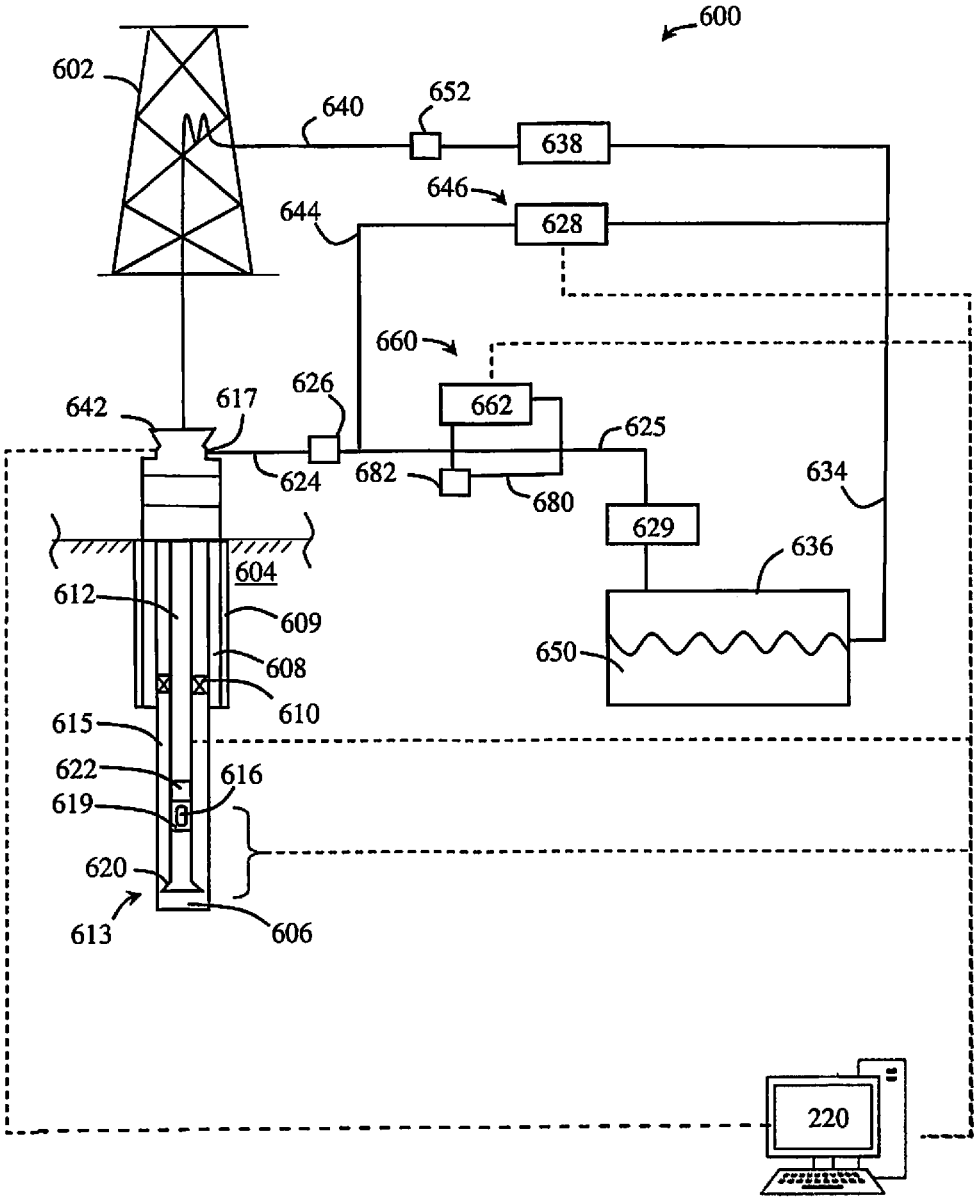
FIG. 3 illustrates a drilling system for tripping drill string with constant circulation bottom hole pressure.

FIG. 3 shows another example of a drilling system according to embodiments of the present disclosure. The drilling system 600 includes a drilling rig 602 that is used to support drilling operations. Many of the components used on a rig 602, such as the kelly, power tongs, slips, draw works, and other equipment are not shown for ease of depiction. The rig 602 is used to support drilling and exploration operations in formation 604. The borehole 606 is shown as being partially drilled, with the casing 608 set and cemented 609 into place. In one embodiment, a casing shutoff mechanism, or downhole deployment valve 610, is installed in the casing 608 to optionally shutoff the annulus and effectively act as a valve to shut off the open hole section when the bit is located above the valve.

The drill string 612 supports a BHA that includes a drill bit 620, a mud motor, a MWD/LWD sensor suite 619, including a pressure transducer 616 to determine the annular pressure, a check valve, to prevent backflow of fluid from the annulus. It also includes a telemetry package 622 that is used to transmit pressure, MWD/LWD as well as drilling information to be received at the surface. A BHA may utilize telemetry systems, such as radio frequency (RF), electromagnetic (EM) or drilling string transmission systems.

As noted above, the drilling process requires the use of a drilling fluid 650, which may be stored in a reservoir 636. A reservoir 636 may be a mud tank, pit, or any type of container that can accommodate a drilling fluid. The reservoir 636 is in fluid communication with one or more mud pumps 638 which pump the drilling fluid 650 through conduit 640. An optional flow meter 652 can be provided in series with the one or more mud pumps, either upstream or downstream thereof. The conduit 640 is connected to the last joint of the drill string 612 that passes through an RCD assembly 642. The RCD assembly 642 isolates the pressure in the annulus while still permitting drill string rotation. The fluid 650 is pumped down through the drill string 612 and the BHA 613 and exits the drill bit 620, where it circulates the cuttings away from the bit 620 and returns them up the open hole annulus 615 and then the annulus formed between the casing 608 and the drill string 612. The fluid 650 returns to the surface and goes through diverter 617 located in the RCD assembly 642, through conduit 624 to an assisted well control system 660 and various solids control equipment 629, such as, for example, a shaker. The assisted well control system 660 will be described in greater detail below.

The RCD assembly 642 may be mounted directly or indirectly on top of the wellhead or a blowout preventer (BOP) stack. The BOP stack may include an annular sealing element (annular BOP) and one or more sets of rams which may be operated to sealingly engage a pipe string disposed in the wellbore through the BOP or to cut the pipe string and seal the wellbore in the event of an emergency.

In conduit 624, a second flow meter 626 may be provided. The flow meter 626 may be a mass-balance type or other high-resolution flow meter. It will be appreciated that by monitoring flow meters 626, 652 and the volume pumped by a backpressure pump 628, the system may be able to determine the amount of fluid 650 being lost to the formation, or conversely, the amount of formation fluid leaking to the borehole 606. Based on differences in the amount of fluid 650 pumped versus fluid 650 returned, the operator may be able to determine whether fluid 650 is being lost to the formation 604, which may indicate that formation fracturing has occurred, i.e., a significant negative fluid differential. Likewise, a significant positive differential would be indicative of formation fluid entering into the wellbore.

After being treated by the solids control equipment 629, the drilling fluid is directed to mud tank 636. Drilling fluid from the mud tank 636 is directed through conduit 634 back to conduit 640 and to the drill string 612. A backpressure line 644, located upstream from the mud pumps 638, fluidly connects conduit 634 to what is generally referred to as a backpressure system 646. In one embodiment, a three-way valve may be placed in conduit 634, which may allow fluid from the mud tank 636 to be selectively directed to the rig pump 638 to enter the drill string 612 or directed to the backpressure system 646.

In another embodiment, a three-way valve may be a controllable variable valve, allowing a variable partition of the total pump output to be delivered to the drill string 612 on the one side and to backpressure line 644 on the other side. This way, the drilling fluid can be pumped both into the drill string 612 and the backpressure system 646. In one embodiment, a three-way fluid junction may be provided in conduit 634, and a first variable flow restricting device may be provided between the three way fluid junction and the conduit 640 to the rig pump 638, and a second variable flow restricting device may be provided between the three way fluid junction and the backpressure line 644. Thus, the ability to provide adjustable backpressure during the entire drilling and completing processes may be provided.

The backpressure pump 628 may be provided with fluid from the reservoir through conduit 634, which is in fluid communication with the reservoir 636. While fluid from conduit 625, located downstream from the assisted well control system 660 and upstream from solids control equipment 629 could be used to supply the backpressure system 646 with fluid, it will be appreciated that fluid from reservoir 636 has been treated by solids control equipment 629. As such, the wear on backpressure pump 628 is less than the wear of pumping fluid in which drilling solids are still present.

In one embodiment, the backpressure pump 628 is capable of providing up to approximately 2200 psi (15168.5 kPa) of backpressure; though higher pressure capability pumps may be selected. The backpressure pump 628 pumps fluid into conduit 644, which is in fluid communication with conduit 624 upstream of the assisted well control system 660. As previously discussed, fluid from the annulus 615 is directed through conduit 624. Thus, the fluid from backpressure pump 628 affects a backpressure on the fluid in conduit 624 and back into the annulus 615 of the borehole. The assisted well control system 660 may include an automatic choke 662 to controllably bleed off pressurized fluid from the annulus 615 or may use a fixed position choke.

Downhole information system 220 includes a computational device in communication with one or more sensors and/or equipment units of the drilling system 600. For example, the downhole information system 220 may be in communication with one or more sensors disposed along the BHA 613, one or more sensors disposed along the drill string 612 (such as pressure and temperature sensors), one or more sensors or control devices of the assisted well control system 660, and one or more sensors or control devices of the backpressure system 646. The downhole information system 220 may collect and analyze data about the drilling system, including but not limited to drilling operating parameters, wellbore parameters, and bottom hole assembly (BHA) parameters.

The downhole information system 220 may be in communication with a computational device 210 used for analyzing, monitoring, and/or designing an RCD assembly according to embodiments of the present disclosure, where the downhole information system 220 may provide information about the drilling operation to the computational device 210. In the embodiment shown in FIG. 3, the downhole information system 220 uses a computational device separate from but in communication with computational device 210. However, in some embodiments, a single computational device may be used both for a downhole information system and for analyzing, monitoring, and/or designing an RCD assembly according to embodiments of the present disclosure.

Further, according to some embodiments of the present disclosure, a drilling system may include a data store for storing data related to an RCD assembly and at least one of the wellbore parameters, drilling performance, BHA parameters, and drilling operating parameters collected from the drilling operation. For example, a data store may store downhole data processed by a processor in a downhole information system. Downhole data may be collected from measurement devices disposed throughout a current drilling operation and processed by the processor of a downhole information system, and/or historical downhole data collected from remote and/or historical drilling operations may be collected and processed in the downhole information system. As used herein, the term historical downhole data may refer to downhole data collected from drilling operations occurring before a current drilling operation, from previously acquired downhole data collected and stored from a current drilling operation, from simulations of drilling operations, and/or from drilling operations conducted previous to or concurrently with but remote from a current drilling operation.

Further, according to some embodiments, one or more drilling parameters of the current drilling operation may be inputted into the modeling software. For example, wellbore parameters, drilling performance parameters, BHA parameters, and drilling operating parameters collected from the current drilling operation, such as by using a downhole information system, as described above, may be inputted into the modeling software.

According to some embodiments, at least one limit on the value of measurement data being collected may be set into the programmable logic controller, such as a maximum or minimum value of the measurement data (e.g., a maximum pressure value, maximum and/or minimum temperature value, maximum displacement, maximum vibration, etc.) being collected from sensors. In such embodiments, an alert may be provided when measurement data is processed outside the set limit(s). For example, if measurement data related to the bottom hole pressure BHP is processed by the programmable logic controller (e.g., in real-time) that is greater than a set maximum pressure limit, an alert may be sent by the programmable logic controller indicating such occurrence.

One or more different actions may be taken when an alarm is provided, or no action may be taken. For example, in some embodiments, at least one drilling parameter of the drilling operation may be altered when an alert is provided. The drilling parameter(s) being changed and the magnitude of the change in response to the alert may be selected to account for the change or to bring the measurement data values being collected within the set limit(s). For example, upon receiving an alert that the bottom hole pressure BHP is over a set maximum pressure limit, one or more drilling parameters may be altered to lower the pressure, such as by increasing the rate of fluid being returned from the annulus.

According to one aspect of the invention, a method is provided for maintaining a constant bottom hole pressure BHP while tripping drill string.

1) Connect top drive to a stand of drill pipe with a circulation sub and insert the wellbore.
2) Drill the wellbore while pumping drilling mud through the top drive
3) Controlling BHP by maintaining flow of drilling mud to the top drive and restricting flow of annulus returns at the choke.
4) Pick up the drill string and position the circulation coupler around the circulation sub.
5) Control BHP by decreasing flow of drilling mud to the top drive, increasing flow of drilling mud to the circulation coupler, and restricting flow of annulus returns at the choke.
6) Control BHP by stopping flow of drilling mud to top drive, maintaining flow of drilling mud to the circulation coupler, and pumping drilling mud into the annulus via a back pressure pump.
7) Disconnecting the top drive from the drill string and connect the op drive to a new stand of drill pipe with a circulation sub.
8) Make up the new stand of drill pipe with a circulation sub to the drill string.
9) Control BHP by stopping the back pressure pumping of drilling mud into the annulus, increasing flow of drilling mud to the top drive, and maintaining flow of drilling mud to the circulation coupler.
10) Control BHP by further increasing flow of drilling mud to the top drive, stopping flow of drilling mud to the circulation coupler, and restricting flow of annulus returns at the choke.
11) Repeat steps 2-10.

A CV curve on the valve may provide a flow rate based on its position, so the system would know how much back pressure to apply to the annulus. The BHP may be calculated based on the flow rate into the drill string and the back pressure applied to the annulus by the back pressure system.

A benefit of the invention is that the system may use a circulation coupler and circulation subs that are rated for lower operation pressure. Because a portion of the BHP is maintained by the back pressure pump, a relatively smaller portion of the BHP may be supplied by the circulation coupler as compared to the entirety of the BHP that may be maintained by the top drive.

Figure 4:
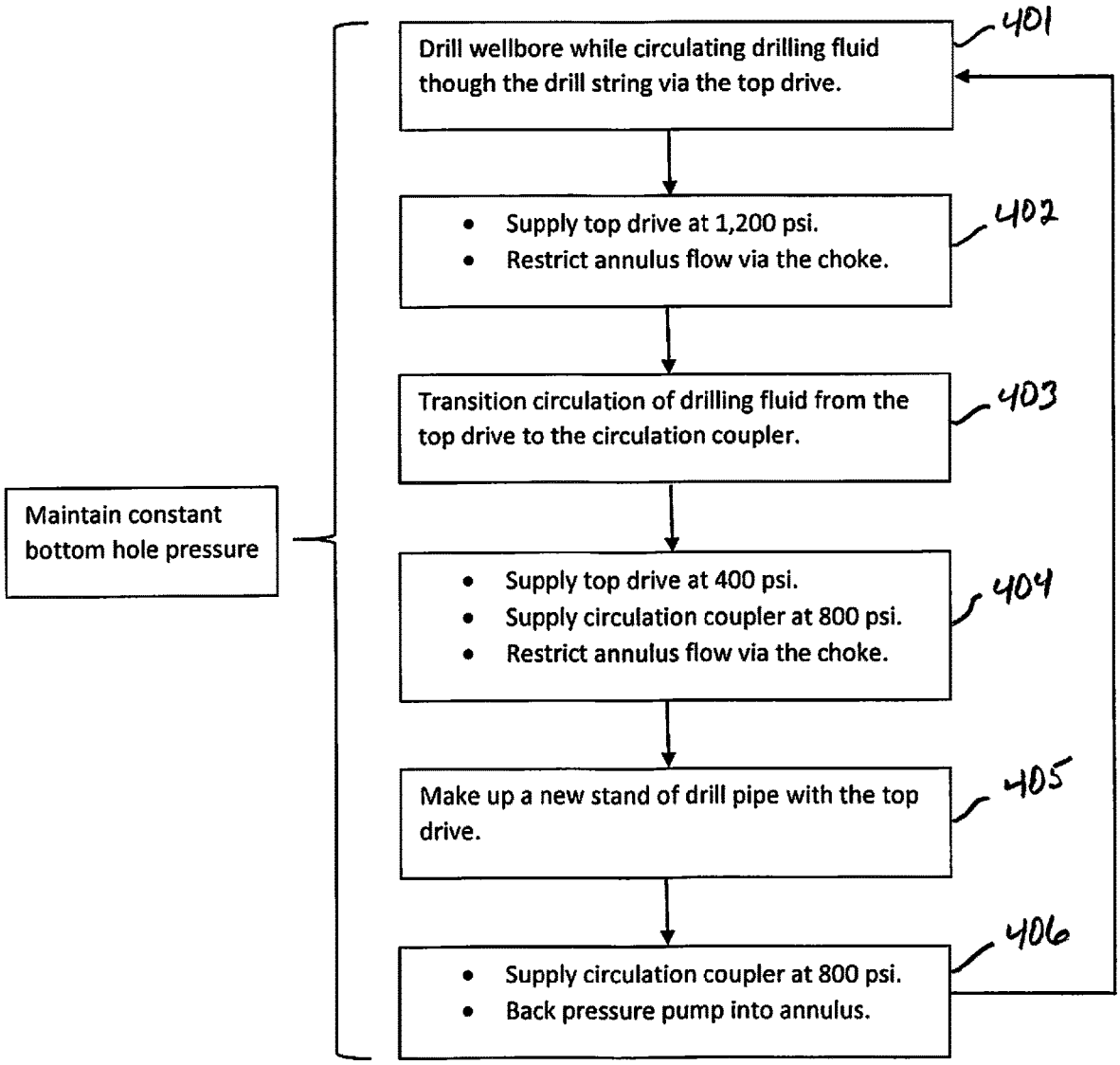
FIG. 4 shows a method for supplying drilling fluid to a drill string during drilling operations so that bottom hole pressure is maintained throughout the operations.

FIG. 4 illustrates an example, wherein the BHP may be maintained at a constant level during a drilling operation by controlling flows into the drill string and out of the annulus and with back flow into the annulus. At step 401, the wellbore is drilled while circulating fluid through the drill string via the top drive. At step 402, the drilling mud is supplied to the top drive at 1,200 psi and the annulus flow is restricted by the choke. At step 403, the circulation of drilling mud is transitioned from the top drive to the circulation coupler by decreasing the top drive flow rate and increasing the circulation coupler flow rate. At step 404, drilling mud is supplied to the top drive at 400 psi and drilling mud is supplied to the circulation coupler at 800 psi, while the flow of drilling mud out of the annulus is restricted by the choke. At step 405, the top drive is a new stand of drill pipe is made up to the top drive while drilling mud is circulated to the drill string entirely by the circulation coupler through the circulation sub at the top of the drill string. At step 406, drilling mud is supplied to the circulation coupler at 800 psi and back pressure is applied to the drilling mud in the annulus by pumping drilling mud into the annulus by the back pressure pump. During steps 401 through 406, the bottom hole pressure BHP at the drill bit is maintained constant. When the top drive is supplying all of the drilling mud to the drill string, 1,200 psi may be applied at the top drive while flow is restricted by the choke to hold pressure in the annulus. When both the top drive and the circulation coupler supply the drilling mud to the drill string, 400 psi may be applied at the top drive and 800 psi may be applied at the circulation coupler while flow is restricted by the choke to hold pressure in the annulus. When the circulation coupler supplies all of the drilling mud to the drill string, 800 psi may be applied at the circulation coupler while drilling mud is pumped into the annulus by the back pressure pump. In all three situations, the BHP may be the same. Thus, by pumping drilling mud back into the annulus when the circulation coupler is the only source of supply to the drill string, both the circulation coupler and circulation sub may be rated for a lower operation pressure.

Although the disclosed embodiments are described in detail in the present disclosure, it should be understood that various changes, substitutions and alterations can be made to the embodiments without departing from their spirit and scope.

What is claimed is:

1. A method for maintaining a bottom hole pressure at a bottom of a wellbore during wellbore drilling operations utilizing a drill string positioned within the wellbore, the method comprising:

supplying drilling fluid, at a first pressure, to the drill string via a top drive adjacent to an upper portion of the drill string such that the bottom hole pressure is provided at the bottom of the wellbore;

while continually supplying drilling fluid to the drill string via the top drive: supplying drilling fluid to the drill string via (i) the top drive at a second pressure lower than the first pressure and (ii) a circulation coupler at a third pressure, wherein the sum of the second and third pressures is approximately the same as the first pressure such that the bottom hole pressure is provided at the bottom of the wellbore; and supplying drilling fluid to the drill string via the circulation coupler at the third pressure while pumping drilling fluid into an annulus of the wellbore via a back pressure pump such that the bottom hole pressure is provided at the bottom of the wellbore, wherein the bottom hole pressure at the bottom of the wellbore is maintained at all times during performance of the method.

2. The method according to claim 1, further comprising:

restricting flow of drilling fluid out of the annulus of the wellbore via a choke to hold pressure in the annulus while supplying the drilling fluid, at the first pressure, to the drill string via the top drive.

3. The method according to claim 2, further comprising:

restricting flow of drilling fluid out of the annulus of the wellbore via the choke to hold pressure in the annulus while supplying the drilling fluid to the drill string via (i) the top drive at the second pressure and (ii) the circulation coupler at the third pressure.

4. The method according to claim 1, further comprising:

constantly circulating drilling fluid to the drill string while adding a new stand of drill pipe to the drill string.

5. The method according to claim 4, further comprising:

maintaining the bottom hole pressure at the bottom of the wellbore while adding the new stand of drill pipe to the drill string.

6. The method according to claim 1, further comprising:
constantly circulating drilling fluid to the drill string while removing a stand of drill pipe from the drill string.

7. The method according to claim 6, further comprising:
maintaining the bottom hole pressure at the bottom of the wellbore while removing the stand of drill pipe from the drill string.

8. The method according to claim 1, wherein the drilling fluid is pumped into the annulus by the back pressure pump at a fourth pressure.

9. A method for maintaining a bottom hole pressure at a bottom of a wellbore during wellbore drilling operations utilizing a drill string positioned within the wellbore, the method comprising:
controlling the bottom hole pressure at the bottom of the wellbore by maintaining flow of drilling fluid to a top drive connected to an upper portion the drill string;
while continually supplying drilling fluid to the drill string via the top drive, positioning a circulation coupler around a circulation portion of the drill string having a radial port configured for supplying drilling fluid to the drill string via the circulation coupler;
controlling the bottom hole pressure by decreasing flow of drilling fluid to the top drive and increasing flow of drilling fluid to the circulation coupler;
controlling the bottom hole pressure by terminating flow of drilling fluid to the top drive, maintaining flow of drilling fluid to the circulation coupler and pumping drilling fluid into an annulus of the wellbore via a back pressure pump;
while continually supplying drilling fluid to the drill string via the circulation coupler, either:
removing a first stand of drill pipe from the drill string, or
adding a second stand of drill pipe to the drill string after disconnecting the top drive from the drill string and connecting the second stand of drill pipe to the disconnected top drive; and
controlling the bottom hole pressure by decreasing flow of drilling fluid to the circulation coupler and increasing flow of drilling fluid to the top drive,
wherein the bottom hole pressure is maintained at all times during performance of the method.

10. The method according to claim 9, further comprising:
restricting flow of drilling fluid out of the annulus of the wellbore via a choke while maintaining the flow of drilling fluid to the top drive.

11. The method according to claim 10, further comprising:
restricting flow of drilling fluid out of the annulus of the wellbore via a choke while decreasing the flow of drilling fluid to the top drive and increasing the flow of drilling fluid to the circulation coupler.

12. The method according to claim 1, wherein the circulation coupler supplies drilling fluid to the drill string through a radial port of a circulation portion of the drill string.

13. A method for maintaining a bottom hole pressure at a bottom of a wellbore during wellbore drilling operations utilizing a drill string positioned within the wellbore, the method comprising:
supplying drilling fluid to the drill string via a top drive;
then, while continually supplying drilling fluid to the drill string via the top drive, positioning a circulation coupler around a circulation portion of the drill string;
then, while continually supplying drilling fluid to the drill string via the top drive, supplying drilling fluid to the drill string via the circulation coupler; and
then, while continually supplying drilling fluid to the drill string via the circulation coupler, disconnecting the top drive from the drill string,
wherein supplying drilling fluid to the drill string via the top drive, before positioning the circulation coupler around the circulation portion, comprises supplying drilling fluid at a first pressure, and
wherein supplying drilling fluid to the drill string via the circulation coupler while continually supplying drilling fluid to the drill string via the top drive comprises:
supplying drilling fluid to the drill string via the circulation coupler at a second pressure; and
supplying drilling fluid to the drill string via the top drive at a third pressure, wherein the sum of the second and third pressures is approximately the same as the first pressure.

14. The method of claim 13 wherein the circulation portion comprises a radial port through which drilling fluid is supplied to the drill string via the circulation coupler.

15. The method of claim 13 further comprising:
while continually supplying drilling fluid to the drill string via the circulation coupler, and after the top drive has been disconnected from the drill string, utilizing the top drive to add a stand of drill pipe to the drill string;
then, while continually supplying drilling fluid to the drill string via the circulation coupler, supplying drilling fluid to the drill string via the top drive; and
then, while continually supplying drilling fluid to the drill string via the top drive, removing the circulation coupler from the drill string.

16. The method of claim 13 wherein disconnecting the top drive from the drill string comprises utilizing the top drive to remove a stand of drill pipe from the drill string, and wherein the method further comprises:
while continually supplying drilling fluid to the drill string via the circulation coupler, disconnecting the removed stand of drill pipe from the top drive;
then, while continually supplying drilling fluid to the drill string via the circulation coupler:
reconnecting the top drive to the drill string; and
supplying drilling fluid to the drill string via the top drive; and
then, while continually supplying drilling fluid to the drill string via the top drive, removing the circulation coupler from the drill string.

* * * * *